US007416026B2

(12) United States Patent
Naquin et al.

(10) Patent No.: US 7,416,026 B2
(45) Date of Patent: Aug. 26, 2008

(54) APPARATUS FOR CHANGING FLOWBORE FLUID TEMPERATURE

(75) Inventors: Carey John Naquin, Katy, TX (US); John R. Hardin, Jr., Spring, TX (US); James W. Estep, Houston, TX (US); David Rios-Aleman, Houston, TX (US); Haoshi Song, Sugar Land, TX (US); Christopher A. Maranuk, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 10/775,840

(22) Filed: Feb. 10, 2004

(65) Prior Publication Data

US 2005/0173125 A1 Aug. 11, 2005

(51) Int. Cl.
*E21B 34/10* (2006.01)
*G05D 11/00* (2006.01)

(52) U.S. Cl. ..... 166/374; 166/320; 166/332.2; 137/110

(58) Field of Classification Search ..... 166/373, 166/374, 320, 321, 332.2; 137/110, 118.06
See application file for complete search history.

(56) References Cited

U.S. PATENT DOCUMENTS 2,968,345 A * 1/1961 Gamble ..... 60/243
3,155,111 A * 11/1964 Presnell ..... 137/504
4,051,864 A * 10/1977 Iwatsuki ..... 137/504
4,176,630 A * 12/1979 Elmer ..... 123/41.12
4,260,020 A * 4/1981 Nelson et al. ..... 166/305.1
4,653,524 A * 3/1987 Wilson ..... 137/110
4,669,541 A * 6/1987 Bissonnette ..... 166/154
4,936,397 A * 6/1990 McDonald et al. ..... 175/26
5,215,444 A * 6/1993 Bishoff ..... 417/281
5,443,129 A * 8/1995 Bailey et al. ..... 175/45
5,615,115 A 3/1997 Shilling
5,826,661 A 10/1998 Parker et al.
6,095,249 A * 8/2000 McGarian et al. ..... 166/319
6,119,783 A 9/2000 Parker et al.
6,158,533 A 12/2000 Gillis et al.
6,250,806 B1 6/2001 Beshoory
6,276,458 B1 8/2001 Malone et al.
6,328,119 B1 12/2001 Gillis et al.
6,353,706 B1 3/2002 Bridges
6,494,265 B2 12/2002 Wilson et al.
6,564,874 B2 5/2003 Narvaez
6,622,794 B2 * 9/2003 Zisk, Jr. ..... 166/373

(Continued)

OTHER PUBLICATIONS

Sperry-Sun Drilling Services, "Adjustable Gauge Stabilizer (AGS-TM) Operations Manual," 17 pp.

*Primary Examiner*—Shane Bomar
(74) *Attorney, Agent, or Firm*—Conley Rose, P.C.

(57) ABSTRACT

A flowbore fluid temperature control system comprising a valve mechanism that adjusts the flow of a fluid through a flowbore. The flowbore fluid temperature control system also comprises an actuator that adjusts the valve mechanism. The flowbore fluid temperature control system also comprises an operating system that operates the actuator and controls the flowbore fluid pressure. The flowbore fluid temperature control system selectively controls the temperature of the flowbore fluid by adjusting the flow of the fluid through the flowbore. The control system controls the actuator and also controls the flowbore fluid pressure to affect the temperature of the flowbore fluid.

19 Claims, 7 Drawing Sheets

U.S. PATENT DOCUMENTS 6,659,186 B2 * 12/2003 Patel ..... 166/386
6,719,071 B1 4/2004 Moyes
6,837,313 B2 1/2005 Hosie et al.
6,938,707 B2 9/2005 Schmidt et al.
6,973,977 B2 12/2005 Naquin
7,114,661 B2 * 10/2006 Goedde ..... 236/93 R
7,306,042 B2 12/2007 Bansal et al.
2003/0066650 A1 4/2003 Fontana
2003/0079912 A1 5/2003 Leuchtenberg
2003/0121663 A1 7/2003 Weng
2003/0127230 A1 7/2003 Von Eberstein, Jr.
2003/0146001 A1 8/2003 Hosie
2004/0007361 A1 * 1/2004 McGarian et al. ..... 166/319
2004/0035578 A1 * 2/2004 Ross et al. ..... 166/250.15
2004/0182443 A1 * 9/2004 McIntosh ..... 137/487

* cited by examiner

APPARATUS FOR CHANGING FLOWBORE FLUID TEMPERATURE

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND

In the drilling industry, a drilling fluid may be used when drilling a wellbore. The drilling fluid may be used to provide pressure in the wellbore, clean the wellbore, cool and lubricate the drill bit, and the like. The wellbore may comprise a cased portion and an open portion. The open portion extends below the last casing string, which may be cemented to the formation above a casing shoe. The drilling fluid is circulated into the wellbore through the drill string. The drilling fluid then returns to the surface through the annulus between the wellbore wall and the drill string. The pressure of the drilling fluid flowing through the annulus acts on the open wellbore. The drilling fluid flowing up through the annulus carries with it cuttings from the wellbore and any formation fluids that may enter the wellbore.

The drilling fluid may be used to provide sufficient hydrostatic pressure in the well to prevent the influx of such formation fluids. The density of the drilling fluid can also be controlled in order to provide the desired downhole pressure. The formation fluids within the formation provide a pore pressure, which is the pressure in the formation pore space. When the pore pressure exceeds the pressure in the open wellbore, the formation fluids tend to flow from the formation into the open wellbore. Therefore, the pressure in the open wellbore is maintained at a higher pressure than the pore pressure. The influx of formation fluids into the wellbore is called a kick. Because the formation fluid entering the wellbore ordinarily has a lower density than the drilling fluid, a kick may potentially reduce the hydrostatic pressure within the wellbore and thereby allow an accelerating influx of formation fluid. If not properly controlled, this influx may lead to a blowout of the well. Therefore, the formation pore pressure comprises the lower limit for allowable wellbore pressure in the open wellbore, i.e. uncased borehole.

While it can be desirable to maintain the wellbore pressures above the pore pressure, if the wellbore pressure exceeds the formation fracture pressure, a formation fracture may occur. With a formation fracture, the drilling fluid in the annulus may flow into the fracture, decreasing the amount of drilling fluid in the wellbore. In some cases, the loss of drilling fluid may cause the hydrostatic pressure in the wellbore to decrease, which may in turn allow formation fluids to enter the wellbore. Therefore, the formation fracture pressure can define an upper limit for allowable wellbore pressure in an open wellbore. In some cases, the formation immediately below the casing shoe will have the lowest fracture pressure in the open wellbore. Consequently, such fracture pressure immediately below the casing shoe is often used to determine the maximum annulus pressure. However, in other instances, the lowest fracture pressure in the open wellbore occurs at a lower depth in the open wellbore than the formation immediately below this casing shoe. In such an instance, pressure at this lower depth may be used to determine the maximum annulus pressure.

Pressure gradients plot a plurality of respective pore, fracture, and drilling fluid pressures versus depth in the wellbore on a graph. Pore pressure gradients and fracture pressure gradients as well as pressure gradients for the drilling fluid have been used to determine setting depths for casing strings to avoid pressures falling outside of the pressure limits in the wellbore. The fracture pressure can be determined by performing a leak-off test below casing shoe by applying surface pressure to the hydrostatic pressure in the wellbore. The fracture pressure is the point where a formation fracture initiates as indicated by comparing changes in pressure versus volume during the leak-off test. The leak-off test can be performed immediately after circulating the drilling fluid. The circulating temperature is the temperature of the circulating drilling fluid, and the static temperature is the temperature of the formation.

Circulating temperatures are sometimes lower than static temperatures. A fracture pressure determined from a leak-off test performed when circulating temperatures just prior to performing the test are less than static temperature is lower than a fracture pressure if the test were performed at static temperature. This is due to the changes in near wellbore formation stress resulting from the lower circulating temperature as compared to the higher static temperature. Similarly, for a circulating temperature higher than static temperature, the fracture pressure determined from a leak-off test would be higher than if the test would be performed at static temperature.

For any given open hole interval, the range of allowable fluid pressures lies between the pore pressure gradient and the fracture pressure gradient for that portion of the open wellbore between the deepest casing shoe and the bottom of the well. The pressure gradients of the drilling fluid may depend, in part, upon whether the drilling fluid is circulated, which will impart a dynamic pressure, or not circulated, which may impart a static pressure. The dynamic pressure sometimes comprises a higher pressure than the static pressure. Thus, the maximum dynamic pressure allowable tends to be limited by the fracture pressure. A casing string must be set or fluid density reduced when the dynamic pressure exceeds the fracture pressure if fracturing of the well is to be avoided. Since the fracture pressure is likely to be lowest at the highest uncased point in the well, the fluid pressure at this point is particularly relevant. In some instances, the fracture pressure is lowest at lower points in the well. For instance, depleted zones below the last casing string may have the lowest fracture pressure. In such instances, the fluid pressure at the depleted zone is particularly relevant.

When drilling a well, the depth of the initial casing strings and the corresponding casing shoes may be determined by the formation strata, government regulations, pressure gradient profiles, and the like. The initial casing strings may comprise conductor casings, surface casings, and the like. The fracture pressures may limit the depth of the casing strings to be set below the casing shoe of the first initial casing string. These casing strings below the initial casing strings are intermediate casing strings and the like. To determine the maximum depth of the first intermediate casing string, a maximum initial drilling fluid density may be initially chosen with the circulating drilling fluid temperature lower than static temperature, which provides a dynamic pressure that does not exceed the fracture pressure at the first casing shoe. The maximum drilling fluid density may also be used to compare the static and/or dynamic pressure gradient to the pore pressure and fracture pressure gradients to indicate an allowable pressure range and a depth at which the casing string should be set. After the first intermediate casing string is set, the maximum density of the drilling fluid can be increased to a pressure at which the dynamic pressure does not exceed the fracture pressure at the casing shoe of the newly set casing string. Such new maximum drilling fluid density may then be used to again compare the static and/or dynamic pressure gradient to the pore pressure and fracture pressure gradients to indicate an allowable pressure range and a depth at which the next casing string should be set. Such procedures are followed until the desired wellbore depth is reached.

BRIEF DESCRIPTION OF THE DRAWINGS

For a more detailed description of the embodiments, reference will now be made to the following accompanying drawings.

DETAILED DESCRIPTION OF THE EMBODIMENTS

The drawings and the description below disclose specific embodiments with the understanding that the embodiments are to be considered an exemplification of the principles of the invention, and are not intended to limit the invention to that illustrated and described. Further, it is to be fully recognized that the different teachings of the embodiments discussed below may be employed separately or in any suitable combination to produce desired results.

Figure 1:
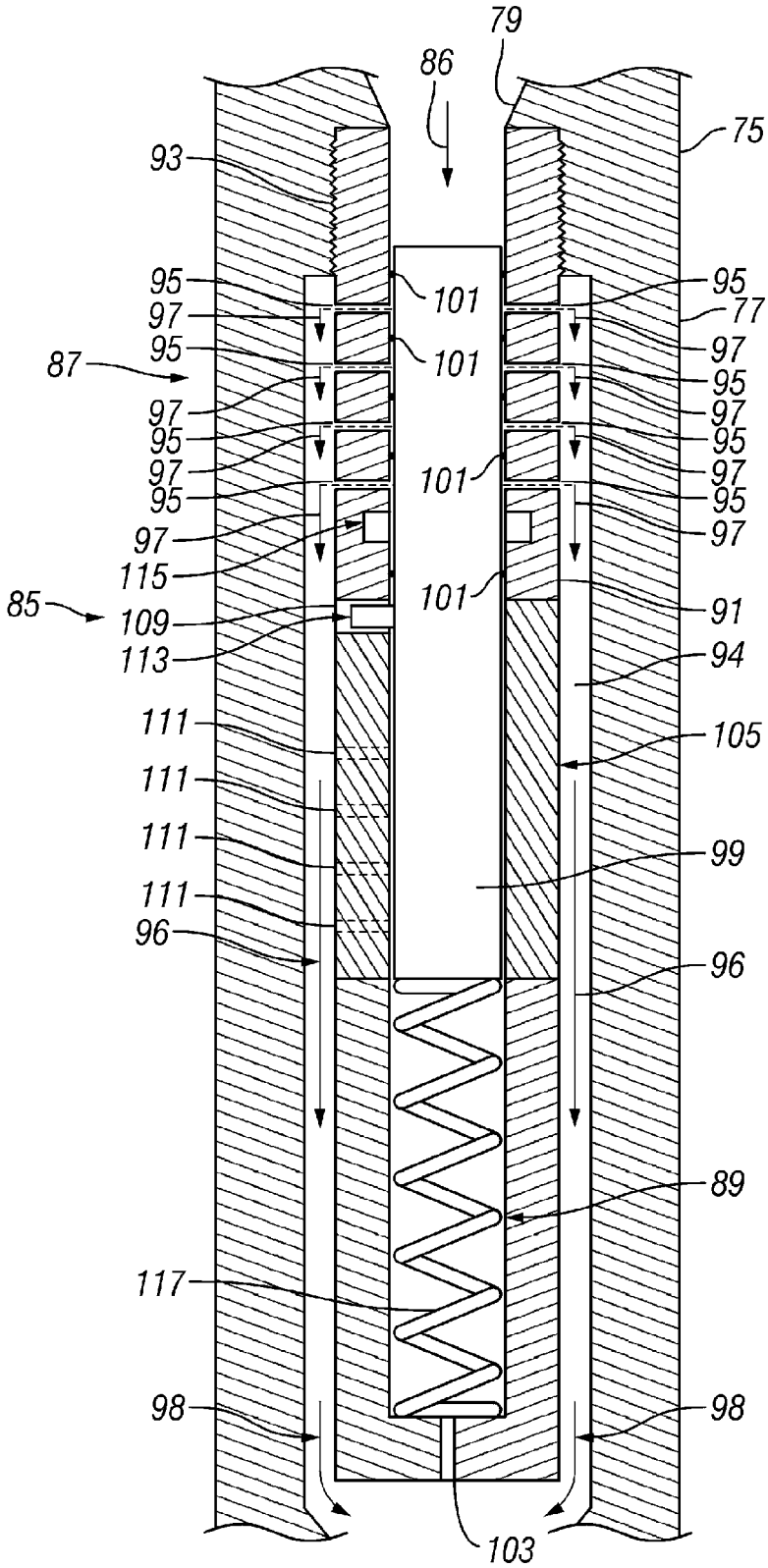
FIG. 1 illustrates a flowbore fluid temperature control system.
Figure 2:
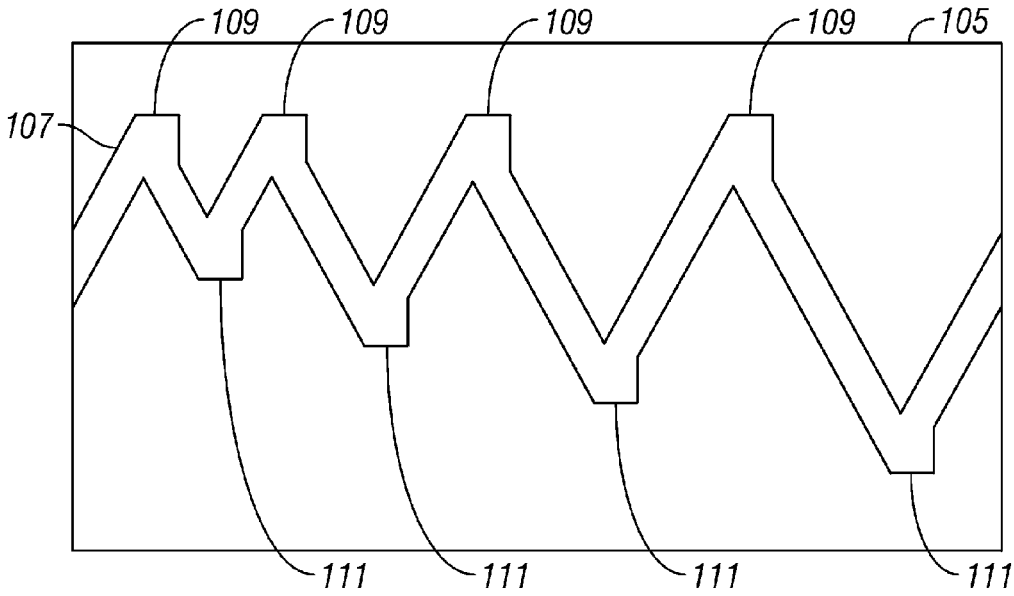
FIG. 2 illustrates a flat view of the inside surface of an optional ratchet embodiments of the apparatus for changing wellbore fluid temperature.
Figure 3A:
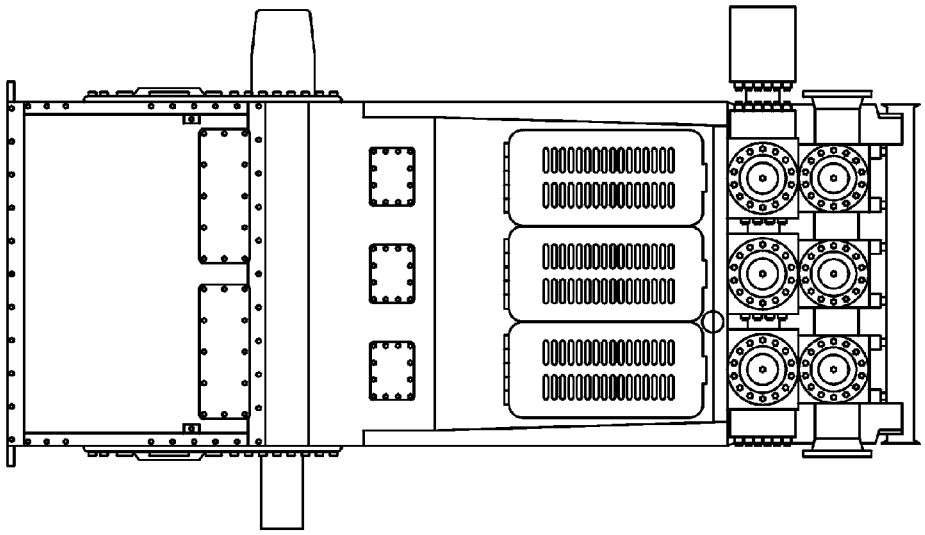
FIG. 3 illustrates a fluid urn used with the flowbore fluid temperature control system.
Figure 3B:
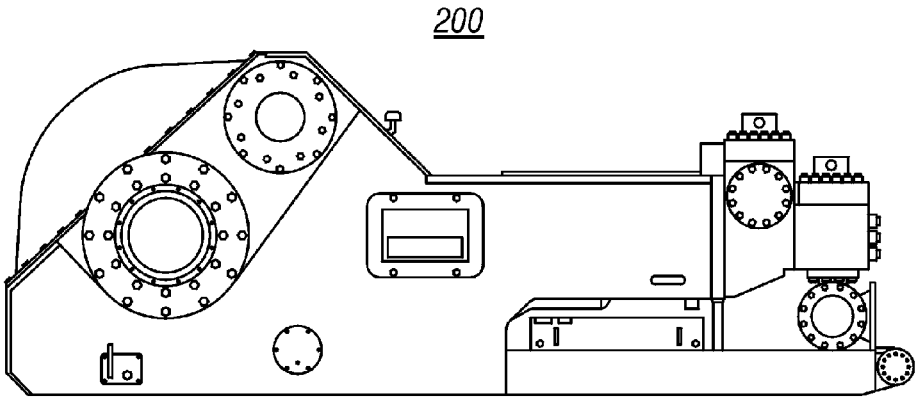
Figure 4:
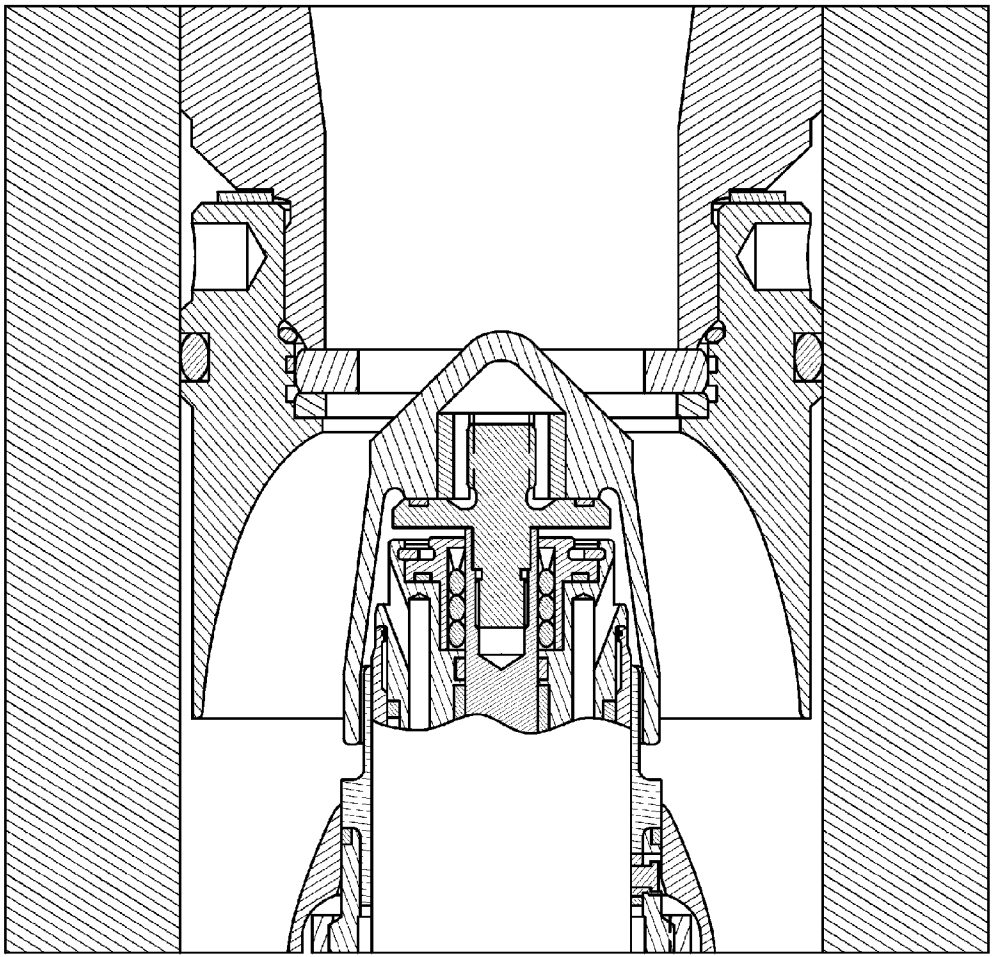
FIG. 4 illustrates a poppet valve that may be used in the flowbore fluid temperature control system, the poppet valve also showing an orifice.
Figure 5:
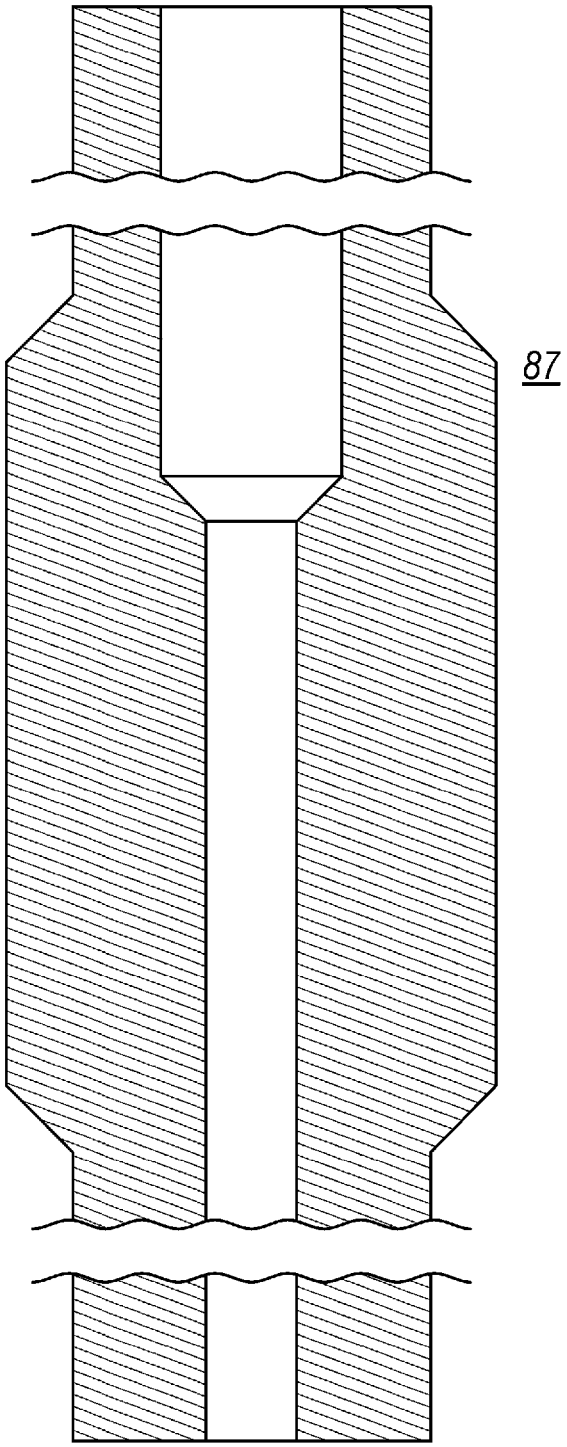
FIG. 5 illustrates a reduced diameter flow path that may be used in the flowbore fluid temperature control system.
Figure 6:
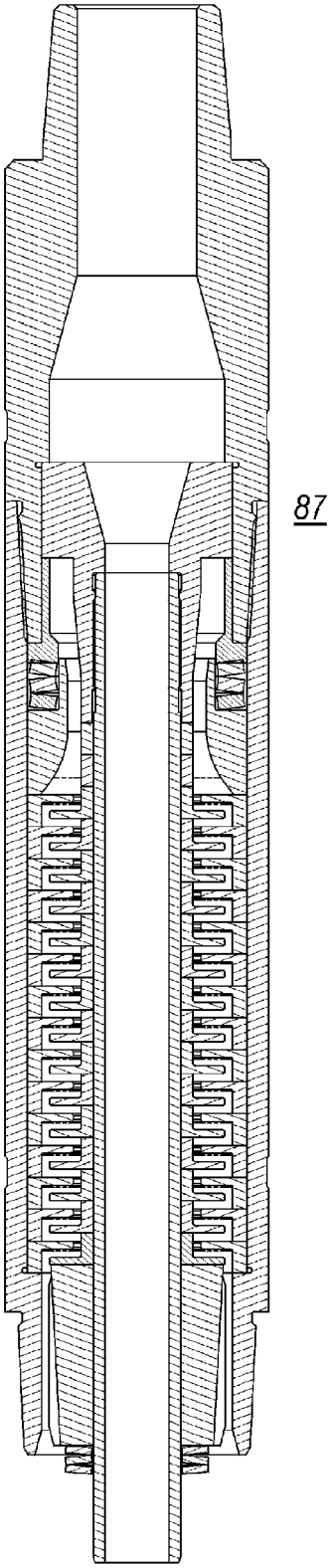
FIG. 6 illustrates a tortuous flow path that may be used in the flowbore fluid temperature control system.
Figure 7:
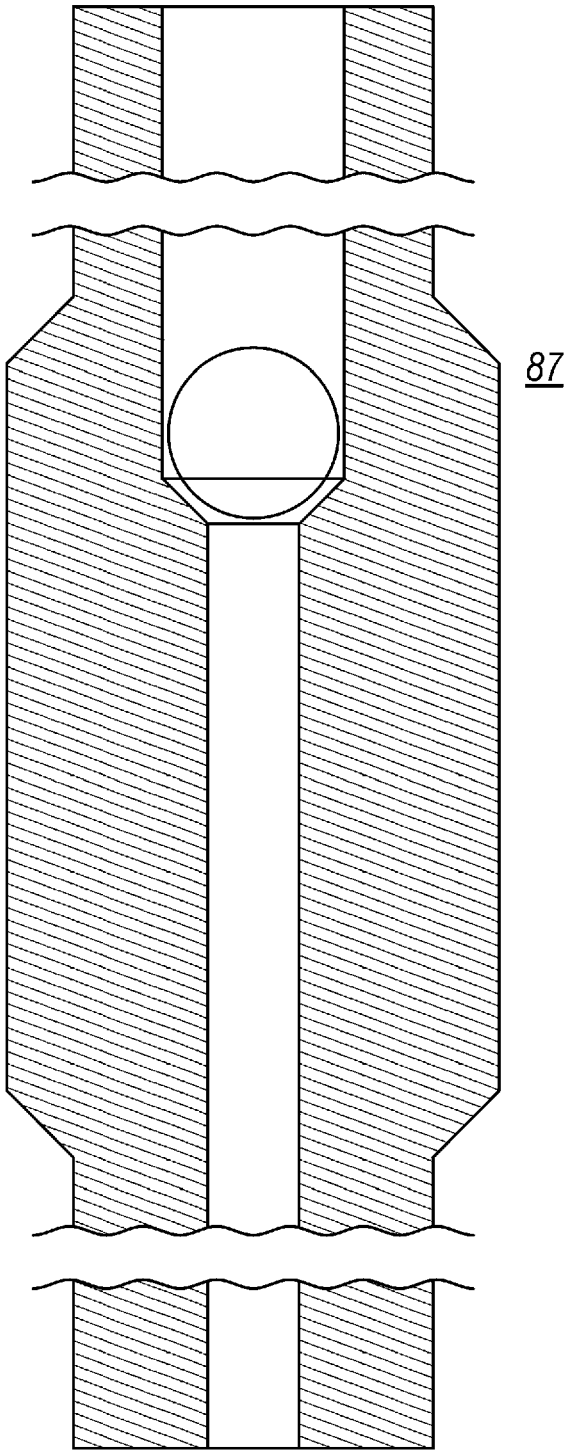
FIG. 7 illustrates a single-posjtion device adapted to create a flow restriction.

The flowbore fluid temperature control system 85 selectively affects the temperature of the fluid flowing through the flowbore of a drill stem by controlling the fluid pressure and flow rate of the flowbore fluid. FIGS. 1 and 2 show an embodiment of a flowbore fluid temperature control system 85. FIG. 1 illustrates a cross-section view of a portion of the sub 75. As shown, sub 75 comprises a body 77 as well as a flowbore 79, which is a continuation of the flowbore of the drill string. Sub 75 also comprises the flowbore fluid temperature control system 85 that selectively affects the temperature of the fluid flowing through the flowbore 79 as designated by arrow 86. The flowbore fluid temperature control system 85 comprises a valve mechanism 87 that adjusts the fluid flow through the flowbore 79. The valve mechanism 87 as shown in FIG. 1 is a multi-position valve mechanism comprising a valve sleeve 91 engaged with the inside of the sub body 77 by threads 93. The outside of the sleeve 91 forms an annulus 94 with the inside of the sub body 77. The valve sleeve 91 also comprises flow ports 95 that allow fluid flow through the sleeve 91 and into the annulus 94 as designated by arrows 97. Within the valve sleeve 91 is a piston 99 that slides to control fluid flow through the flow ports 95. The piston includes seals 101 that prevent fluid flow across the seals 101 between the outside of the piston 99 and the inside of the valve sleeve 91. The piston 99 controls fluid flow through the valve sleeve 91 by selectively opening and closing fluid flow through the flow ports 95 as the piston 99 slides within the valve sleeve 91. The valve sleeve 91 also includes a vent port 103 that allows the pressure inside of the valve sleeve to adjust with the movement of the piston 99.

As best shown in FIG. 1 and 2, the valve sleeve 91 also includes a ratchet sleeve 105. FIG. 2 shows the inside of the ratchet sleeve 105 opened flat. As shown, the inside of the ratchet sleeve 105 includes a circumferential groove 107 that reciprocates between first positions 109 and second positions 111 around the inside of the ratchet sleeve 105. The groove 107 also may be incorporated within the valve sleeve 91 itself, without the need for a separate ratchet sleeve 105. As shown in FIG. 2, on the outside of the piston 99 is a ratchet lug 113 that travels within the groove 107. As the ratchet lug 113 travels between the first and second positions 109, 111 of the groove 107, the piston 99 reciprocates axially as well as rotates within the valve sleeve 91. At each first and second position 109, 111 the piston 99 selectively opens or closes flow ports 95 to allow varying fluid flow rates through the valve sleeve 91. Also included within the flowbore fluid temperature control system 85 is an optional lock ring 115. The lock ring 115 engages the piston 99 to lock the piston 99 into a selected position, thus maintaining a selected flow rate through the valve sleeve 91.

The valve mechanism 87 may also comprise other types of valve mechanisms. For example, the valve sleeve 91 may not include the ratchet sleeve 105 for controlling the position of the piston 99. The valve mechanism 87 may also comprise a single-position valve mechanism such as a poppet valve, an orifice, a reduced-diameter flow path, or a tortuous flow path. The valve mechanism 87 may also comprise single position devices used to create flow restrictions such as a flow restrictor placed in the flowbore. For example, the flow restrictor may be a ball, a sleeve, or bar dropped into the flowbore to create a flow restriction. Altering the restriction in the flowbore may comprise removing the drill string from the wellbore to change the restriction of the flowbore. Altering the restriction in the flowbore may also require using wireline fishing methods to install and/or retrieve the restriction device from the flowbore. The flowbore fluid temperature control system 85 may also comprise more than one valve mechanism 87.

As shown in FIG. 1, the flowbore fluid temperature control system 85 further comprises an actuator mechanism 89, which comprises a spring 117 adapted to compress with the movement of the piston 99. The actuator mechanism 89 may also be comprise any other type of actuator for controlling the valve mechanism 87. For example, the actuator mechanism 89 may comprise a mechanical actuator such as a spring, an electrical actuator such as an electric motor, or a hydraulic actuator such as a hydraulic piston. The actuator mechanism 89 may also be an apparatus that places the ball, sleeve, bar, or other single position restrictive device into the flowbore.

An operating system selectively operates the actuator mechanism 89 and controls the fluid pressure in the flowbore 79. The operating system of the flowbore fluid temperature control system 85 may comprise a fluid pump 200 located in the drill string 20 or on the surface 15 that controls the fluid pressure within the flowbore 79. The operating system thus operates the actuator mechanism 89, and thus controls the position of the piston 99, by controlling the fluid pressure within the flowbore 79. Increasing the fluid pressure within the flowbore 79 produces a first load on the piston 99 in the direction of the fluid flow 86, thus causing the piston 99 to move and compress the spring 117. As the piston 99 compresses the spring 117, the piston 99 moves axially within the valve sleeve 91 and selectively opens the flow ports 95 to produce a desired flow rate. Moving the piston 99 axially within the valve sleeve 91 also moves the ratchet lug 113 within the ratchet sleeve groove 107. As the piston 99 moves axially to compress the spring 117, the ratchet lug 113 moves to one of the second positions 111, rotating the piston 99 within the valve sleeve 91. Once the ratchet lug 113 reaches one of the selected second positions 111, the piston 99 is prevented from moving further axially to compress the spring 117. Thus, any further increase in fluid pressure within the flowbore 79 will not move the piston 99 to compress the spring 117 any further.

The operating system also selectively decreases the fluid pressure within the flowbore 79. Compressing the spring 117 creates a second load on the piston 99 from the spring 117. A decrease in the fluid pressure within the flowbore 79 allows the spring 117 to expand and thus move the piston 99 in the opposite direction of the fluid flow 86. As the spring 117 moves the piston 99, the piston 99 moves axially within the valve sleeve 91 and selectively closes flow ports 95 to produce a desired flow rate. Moving the piston 99 axially within the valve sleeve 91 also moves the ratchet lug 113 within the ratchet sleeve groove 107. As the spring 117 moves the piston 99 axially, the ratchet lug 113 moves to one of the first positions 109, rotating the piston 99 within the valve sleeve 91. Once the ratchet lug 113 reaches one of the selected first positions 109, the piston 99 is prevented from moving further axially. Thus, any further decrease in fluid pressure within the flowbore 79 will not allow the spring 117 to move the piston 99 any further.

The operating system also moves the piston 99 such that the ratchet lug 113 travels in the ratchet groove 107, reciprocating the piston 99 between the first positions 109 and second positions 111 successively as the piston 99 rotates within the valve sleeve 91. Successive increases and decreases in the fluid pressure within the flowbore 79 thus cause the piston 99 to selectively move under the force of the fluid pressure and the force of the spring 117 as the ratchet lug 113 travels through the first positions 109 and the second positions 111. The operating system and the actuator mechanism 89 thus control the number of the flow ports 95 that are exposed to the flowpath by selectively positioning the ratchet lug 113, and thus the piston 99 at a desired first position 109 or second position 111. Movement of the ratchet lug 113 within the groove 107, and thus the movement of the piston 99, allows varying fluid flow rates through the valve sleeve 91. When a desired number of exposed flow ports 95 are selected, the operating system may be used to cycle the piston 99 through the positions of the ratchet groove 107 until the piston 99 reaches the position that allows the desired flow rate.

The operating system may remotely operate the actuator mechanism 89 as discussed above. The operating system may also directly operate the actuator mechanism 89. The operating system may also be any system for operating the actuator mechanism 89. For example, the operating system may be mechanical such as a rotation or reciprocation device; hydraulic such as applied pressure, controlled fluid flow rate, or pressure pulse telemetry; electrical such as a generator power supply; or acoustic such as a sonar device.

The flowbore fluid temperature control system 85 operates to control the temperature of the fluid in the flowbore 79. Fluid flows through the flowbore 79 as depicted by direction arrow 86. The fluid then travels through the flow ports 95 of the valve sleeve 91. The fluid then continues to flow through the flowbore 79 as designated by arrows 96 and 98. When the piston 99 is in one the second positions 111, further increasing the flowbore fluid pressure does not move the piston 99 any further axially in the direction of the fluid flow 86. Thus, fluid pressure in the flowbore 86 may be increased without increasing the flow area through the valve sleeve 91. Increasing the fluid pressure in the flowbore 79 above the valve mechanism 87 while maintaining the fluid flow area through the valve mechanism 87 increases the drop in fluid pressure across the valve mechanism 87. Increasing the fluid pressure drop across the valve mechanism 87 increases the temperature of the flowbore 87 fluids as they pass through the valve mechanism 87. The temperature of the flowbore fluid is increased due to the absorption of heat released from the fluid pressure drop. The heat is released as the fluid energy is expended across the fluid pressure drop due to the conservation of energy principle defined by the first law of thermodynamics. The amount of temperature increase of the wellbore fluid is determined by the heat capacity and density of the fluid and the fluid pressure drop. For example, assuming a completely insulated system where all the heat is absorbed by the fluid, a 1000 $lbf/in^2$ fluid pressure drop with a fluid that has a heat capacity of 0.5 BTU/lbm-° F. and density of 10 lbm/gal, the fluid temperature will increase by 4.9° F.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A flowbore fluid temperature control system comprising:

a control system body comprising a flowbore extending through the length of the control system body and comprising an inlet and an outlet such that all flowbore fluid entering the control system body inlet exits the control system outlet;

a valve mechanism within the control system body that controls the flow of flowbore fluid through the flowbore while maintaining the flowbore fluid in the control system body flowbore, the valve mechanism comprising:

a valve sleeve within the flowbore forming an annulus between the outside of the valve sleeve and the inside of the control system body;

the valve sleeve comprising flow ports allowing fluid flow through the valve sleeve and into the annulus;

the inside of the valve sleeve further comprising a circumferential groove that reciprocates between multiple first and second positions;

a piston slidingly engaging the inside of the valve sleeve, the position of the piston within the valve sleeve controlling the fluid flow through the flow ports;

the piston further comprising a ratchet lug extending from the piston that travels within the groove such that:

the piston moves axially under a first load until the ratchet lug moves to one of the second positions, the ratchet lug rotating the piston as the ratchet lug travels to one of the second positions;

the piston moves axially under a second load until the ratchet lug moves to one of the first positions, the ratchet lug rotating the piston as the ratchet lug travels to one of the first positions; and the piston selectively moves between the first and second positions as the piston rotates within the valve sleeve; and the position of the piston in the first and second positions allows varying flow rates through the valve sleeve;

an actuator that adjusts the valve mechanism;

an operating system that operates the actuator and controls the flowbore fluid pressure; and the temperature of the flowbore fluid being controlled by controlling the pressure drop of the flowbore fluid across the valve mechanism.

2. The flowbore fluid temperature control system of claim 1 further comprising a seal preventing fluid flow across the seal between the outside of the piston and the inside of the valve sleeve.

3. The flowbore fluid temperature control system of claim 1 where the valve sleeve further comprises an outer threaded portion that threadingly engages an inner threaded portion of the flowbore.

4. The flowbore fluid temperature control system of claim 1 where the actuator further comprises a spring within the valve sleeve that interacts with the piston.

5. The flowbore fluid temperature control system of claim 1 where the piston moves in a first direction with an increase in flowbore fluid pressure such that the force of the flowbore fluid pressure causes the piston to compress a spring.

6. The flowbore fluid temperature control system of claim 1 where flowbore fluid pressure provides the first load.

7. The flowbore fluid temperature control system of claim 1 where a spring that is compressed as the piston moves to the second positions provides the second load.

8. The flowbore fluid temperature control system of claim 1 where, once the piston is in one of the second positions, the valve mechanism maintains a selected fluid flow rate with an increase in the flowbore fluid pressure.

9. The flowbore fluid temperature control system of claim 1 where a lock ring locks the piston in a selected second position.

10. The flowbore fluid temperature control system of claim 1 where the operating system further comprises a fluid pump that controls the fluid pressure within the flowbore.

11. The flowbore fluid temperature control system of claim 1 where the operating system operates the actuator mechanism to position the valve mechanism and selectively control the amount of fluid flow through the valve mechanism.

12. The flowbore fluid temperature control system of claim 1 where the actuator is selected from the group consisting of a mechanical actuator, an electrical actuator, and a hydraulic actuator.

13. The flowbore fluid temperature control system of claim 1 were the operating system is selected from the group consisting of a mechanical system, a hydraulic system, an electrical system, and an acoustic system.

14. A method of controlling the temperature of a flowbore fluid comprising:

flowing flowbore fluid through a control system body having a flowbore therethrough comprising an inlet and an outlet such that all flowbore fluid entering the control system body inlet exits the control system outlet;

flowing the flowbore fluid through a valve mechanism in the flowbore;

selectively adjusting the valve mechanism with an actuator, the valve mechanism comprising:

a valve sleeve within the flowbore forming an annulus between the outside of the valve sleeve and the inside of the control system body;

the valve sleeve comprising flow ports allowing fluid flow through the valve sleeve and into the annulus;

the inside of the valve sleeve further comprising a circumferential groove that reciprocates between multiple first and second positions;

a piston slidingly engaging the inside of the valve sleeve, the position of the piston within the valve sleeve controlling the fluid flow through the flow ports; and the piston further comprising a ratchet lug extending from the piston that travels within the groove;

wherein selectively adjusting the valve mechanism comprises:

moving the piston axially under a first load until the ratchet lug moves to one of the second positions, the ratchet lug rotating the piston as the ratchet lug travels to one of the second positions;

moving the piston axially under a second load until the ratchet lug moves to one of the first positions, the ratchet lug rotating the piston as the ratchet lug travels to one of the first positions; and allowing varying flow rates through the valve sleeve in the first and second positions;

maintaining the flowbore fluid in the control system body flowbore as the fluid flows through the valve mechanism;

operating the actuator with an operating system; and controlling the temperature of the flowbore fluid by controlling the pressure drop across the valve mechanism.

15. The method of claim 14 where operating the actuator further comprises selectively adjusting the fluid pressure in the flowbore.

16. The method of claim 14 further comprising interacting the piston with a spring.

17. The method of claim 14 further comprising:

increasing the fluid flow through the valve sleeve by selectively increasing the flowbore fluid pressure to move the piston in a first direction in the valve sleeve, the piston opening flow ports in the valve sleeve and compressing a spring as the piston moves in the first direction; and decreasing the fluid flow through the valve sleeve by selectively decreasing the flowbore fluid pressure to allow the spring to move the piston in a second direction in the valve sleeve, the piston closing flow ports in the valve sleeve as the piston moves in the second direction.

18. The method of claim 14 comprising maintaining a selected flow rate through the valve sleeve and increasing the temperature of the flowbore fluid by increasing the fluid pressure of the flowbore fluid entering the valve sleeve.

19. The method of claim 17 where the axial forces are caused by the fluid pressure in the flowbore in a first direction and the spring in a second direction.

* * * * *